US011819982B2

(12) United States Patent
Lin

(10) Patent No.: US 11,819,982 B2
(45) Date of Patent: Nov. 21, 2023

(54) HIGH-LOADING RATCHET TOOL

(71) Applicant: Tsung-Te Lin, Taichung (TW)

(72) Inventor: Tsung-Te Lin, Taichung (TW)

( * ) Notice: Subject to any disclaimer, the term of this patent is extended or adjusted under 35 U.S.C. 154(b) by 497 days.

(21) Appl. No.: 17/020,067

(22) Filed: Sep. 14, 2020

(65) Prior Publication Data

US 2021/0129297 A1 May 6, 2021

(30) Foreign Application Priority Data

Nov. 1, 2019 (TW) ..... 108139718

(51) Int. Cl.
*B25B 13/46* (2006.01)

(52) U.S. Cl.
CPC ..... *B25B 13/462* (2013.01)

(58) Field of Classification Search
CPC .... B25B 13/462; B25B 13/463; B25B 13/466
USPC ..... 81/59.1, 60, 63.1
See application file for complete search history.

(56) References Cited

U.S. PATENT DOCUMENTS 9,789,593 B2 * 10/2017 Kao ..... B25B 13/463
2005/0120832 A1 * 6/2005 Chiang ..... B25B 13/461 81/59.1
2010/0186555 A1 * 7/2010 Hu ..... B25B 13/463 81/63.2
2013/0319184 A1 * 12/2013 Chen ..... B25B 13/463 81/63.1

* cited by examiner

*Primary Examiner* — David B. Thomas
*Assistant Examiner* — Shantese L McDonald
(74) *Attorney, Agent, or Firm* — Egbert, McDaniel & Swartz, PLLC

(57) ABSTRACT

Disclosed is a high-loading ratchet tool, which has a main body, a braking structure and a working part, wherein the main body forms a first receiving groove, a second receiving groove and a third receiving groove, and the second receiving groove and the third receiving groove are mainly composed of two circular surfaces, and the braking structure is disposed on the main body. The braking structure has a ratchet, and the two ends of the ratchet respectively form a first shaft segment and a second shaft segment. The first shaft segment is disposed in the second receiving groove, and the second shaft segment is disposed in the third receiving groove. According to this, the relative force of the first shaft segment and the second shaft segment and the main body is dispersed, and enhancing the working part restrictions on external torsion.

4 Claims, 10 Drawing Sheets

HIGH-LOADING RATCHET TOOL

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a ratchet tool, and more particularly to the innovative structure type of a high-loading ratchet tool.

2. Description of Related Art Including Information Disclosed Under 37 CFR 1.97 And 37 CFR 1.98

The ratchet wrench is a ratchet tool using ratchet mechanism to implement one-way back stop actuation, as shown in FIG. 1 and FIG. 2. The known ratchet wrench comprises a handle 11, a working part 12 and a braking structure 13, wherein one end of the handle 11 is provided with the working part 12 and the braking structure 13. The working part 12 is connected to a sleeve (not shown in the figure), so that the working part 12 drives the sleeve to rotate. The braking structure 13 comprises a ratchet 14, a brake block 15 and a switchover element 16. The ratchet 14 is coupled with the working part 12. The brake block 15 engages with the ratchet 14 to form one-way stop, so as to restrict the ratchet 14 to unidirectional rotation. The switchover element 16 is in contact with the brake block 15 for transforming the stopping state of the brake block 15 and the ratchet 14, so as to transform the direction of unidirectional rotation of the ratchet 14.

The two ends of the ratchet 14 axially form a circular first shaft segment 17 and a circular second shaft segment 18 respectively. The handle 11 forms a first receiving groove 112 for receiving the ratchet 14. The two ends of the first receiving groove 112 of the handle 11 form a circular second receiving groove 114 and a circular third receiving groove 116 respectively. The first shaft segment 17 is pivoted in the second receiving groove 114, the second shaft segment 18 is pivoted in the third receiving groove 116, based on the working part 12 and the ratchet 14 required of easy rotation, the outside diameter of the first shaft segment 17 is a little smaller than the inside diameter of the second receiving groove 114, and the outside diameter of the second shaft segment 18 is a little smaller than the inside diameter of the third receiving groove 116.

The known ratchet wrench still has the following problems and defects in practical application:

The working part 12 is used for connecting the sleeve, the sleeve is fitted over a driven object (not shown in the figure). The working part 12 indirectly brakes the driven object through the sleeve. The driven object is rotatably installed or removed. The driven object can be a bolt or a nut cap or a similar object. The working part 12 applies a torsion to the driven object through the sleeve to rotate the driven object, The driven object generates a stress, the stress is transferred through the sleeve to the working part 12, so that the working part 12 and the ratchet 14 move away from the brake block 15, and then the outer edge of the first shaft segment 17 is in single line contact with the second receiving groove 114 (as shown in FIG. 3), and the outer edge of the second shaft segment 18 is in single line contact with the third receiving groove 116. The relative force between the first shaft segment 17 and the second receiving groove 114 concentrates on single line contact, the first shaft segment 17 or the second receiving groove 114 is likely to be damaged. The relative force between the second shaft segment 18 and the third receiving groove 116 concentrates on single line contact, the second shaft segment 18 or the third receiving groove 116 is likely to be damaged, so that the torsion applied by the working part 12 to the sleeve is limited. If the load capacity of ratchet tool for the relative force from the driven object can be increased, the torsion applied by the working part 12 to the sleeve can be increased.

The existing method for enhancing the load capacity of ratchet tool for acting force is to change the materials or manufacturing methods of the working part 12, the ratchet 14 and relevant structures with the ratchet 14.

Therefore, for said problems in the known technology of ratchet tool, how to develop an innovative structure with more ideal practicability is the objective and direction of the related circles. In view of this, based on the inventor's years' experience in manufacturing, developing and designing related products, the present invention with practicability is obtained after detailed design and careful evaluation for said objective.

BRIEF SUMMARY OF THE INVENTION

The primary object of the present invention is to provide a high-loading ratchet tool, the technical problem to be solved is to break through how to develop a novel ratchet tool with higher load capacity and more ideal practicability.

Based on said purpose, the technical characteristic of problem solving of the present invention is that the high-loading ratchet tool comprises a main body, a braking structure and a working part, wherein the main body forms a first receiving groove, a second receiving groove and a third receiving groove. The first receiving groove, the second receiving groove and the third receiving groove are axially connected, the first receiving groove is located between the second receiving groove and the third receiving groove.

The braking structure is disposed on the main body, the braking structure comprises a ratchet and a brake block, wherein the brake block engages with the ratchet to form one-way stop. The two ends of the ratchet axially form a circular first shaft segment and a circular second shaft segment respectively. The ratchet can be movably disposed in the first receiving groove. The first shaft segment can be movably disposed in the second receiving groove, the second shaft segment can be movably disposed in the third receiving groove.

The working part is coupled with the first shaft segment, so that the working part directly or indirectly brakes unidirectional rotation of a driven object.

The radius of the first shaft segment is R1, the second receiving groove is composed of a first circular surface and a second circular surface opposite to each other. The second circular surface is located on the side of the first circular surface far from the brake block. The center of the second circular surface is located in the second receiving groove. The radius of the first circular surface is R2, the radius of the second circular surface is R3, R2>R1≥R3, so as to disperse the relative force of the first shaft segment and the second receiving groove. The radius of the second shaft segment is R4. The third receiving groove is composed of a third circular surface and a fourth circular surface opposite to each other. The fourth circular surface is located on the side of the third circular surface far from the brake block. The center of the fourth circular surface is located in the third receiving groove. The radius of the third circular surface is R5, the radius of the fourth circular surface is R6, R5>R4≥R6, so as to disperse the relative force of the first shaft segment and the second receiving groove. In terms of main effect and advantages, the present invention can bear higher acting force, so that the restriction of the working part on external torsion is enhanced.

DETAILED DESCRIPTION OF THE INVENTION

FIG. 4 to FIG. 12 show several specific embodiments of the high-loading ratchet tool of the present invention, but the embodiments are for illustration only, the patent application is not limited to this structure.

Figure 1:
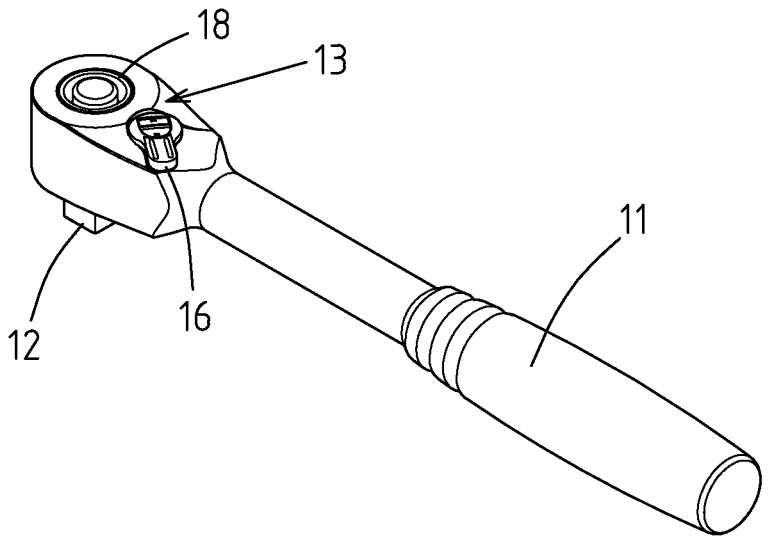
FIG. 1 is the three-dimensional diagram of the known ratchet wrench.
Figure 2:
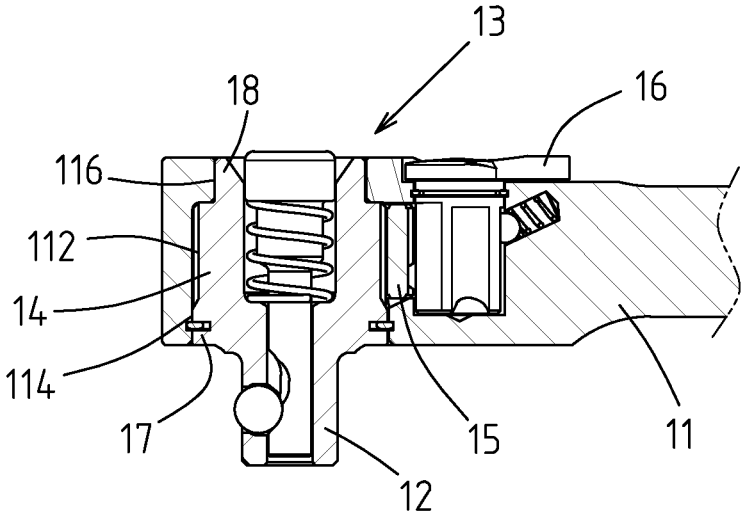
FIG. 2 is the axial sectional view of working part and braking structure of the known ratchet wrench.
Figure 3:
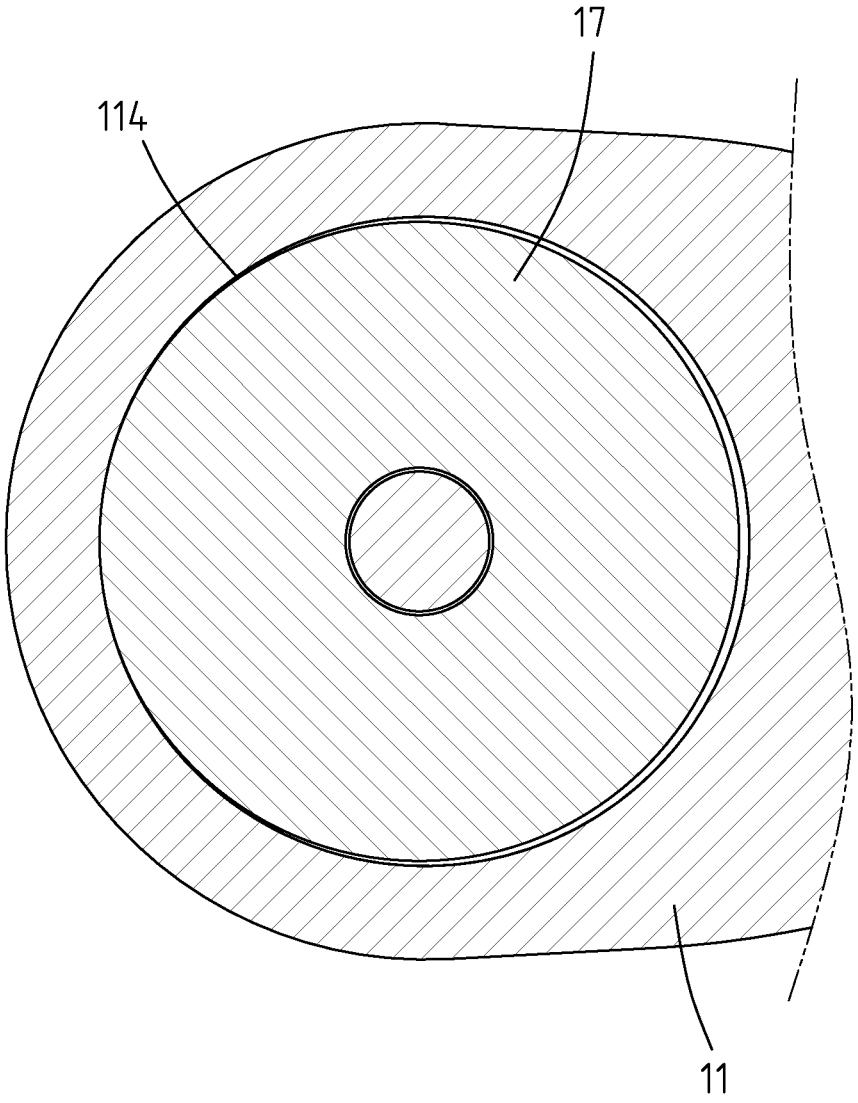
FIG. 3 is the drawing of radial partial enlargement of the first shaft segment and the second receiving groove of the known ratchet wrench, presenting the contact between the first shaft segment and the second receiving groove.
Figure 4:
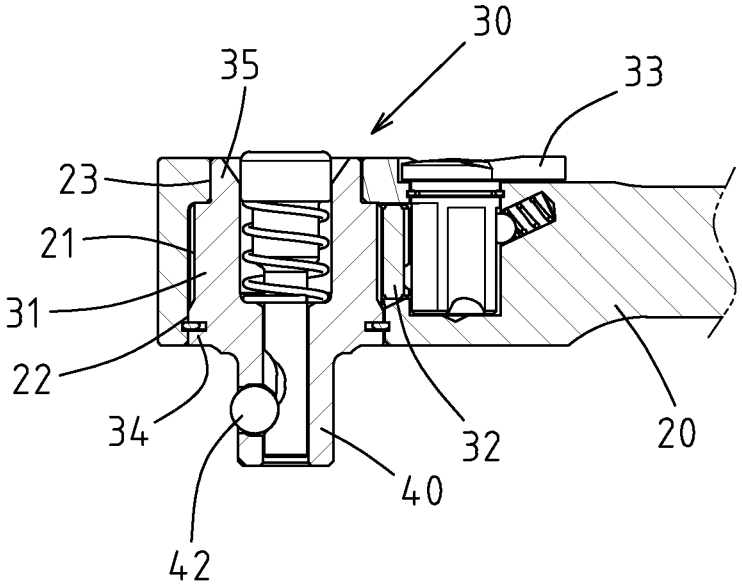
FIG. 4 is the axial sectional view of working part and braking structure in Embodiment 1 of the present invention.

FIG. 4 shows the Embodiment 1 of high-loading ratchet tool of the present invention, including a main body 20, a braking structure 30 and a working part 40, wherein the main body 20 forms a first receiving groove 21, a second receiving groove 22 and a third receiving groove 23. The first receiving groove 21, the second receiving groove 22 and the third receiving groove 23 are axially connected, the first receiving groove 21 is located between the second receiving groove 22 and the third receiving groove 23.

The braking structure 30 is disposed on the main body 20. The braking structure 30 comprises a ratchet 31, a brake block 32 and a switchover element 33, wherein the two ends of the ratchet 31 axially form a circular first shaft segment 34 and a circular second shaft segment 35. The ratchet 31 can be movably pivoted in the first receiving groove 21, the first shaft segment 34 can be movably disposed in the second receiving groove 22, the second shaft segment 35 can be movably disposed in the third receiving groove 23. The brake block 32 engages with the ratchet 31 to form one-way stop, so as to restrict unidirectional rotation of the ratchet 31. The switchover element 33 is in contact with the brake block 32, so as to transform the stopping state of the brake block 32 and the ratchet 31. The switchover element 33 is optional, the braking structure 30 can be free of the switchover element 33 for some purposes. The braking structure 30 is the existing technology familiar to the persons of the technical field. The composition will not be described in detail.

The working part 40 is coupled with the first shaft segment 34. The working part 40 is a column, and a bulge 42 is formed on one side of the working part 40, so that the working part 40 is inserted in a sleeve (not shown in the figure). The sleeve is fitted over a driven object (not shown in the figure), the working part 40 indirectly brakes the rotation of the driven object through the sleeve. The driven object is rotatablely installed or removed, the driven object can be a bolt or a nut cap or a similar object.

Figure 5:
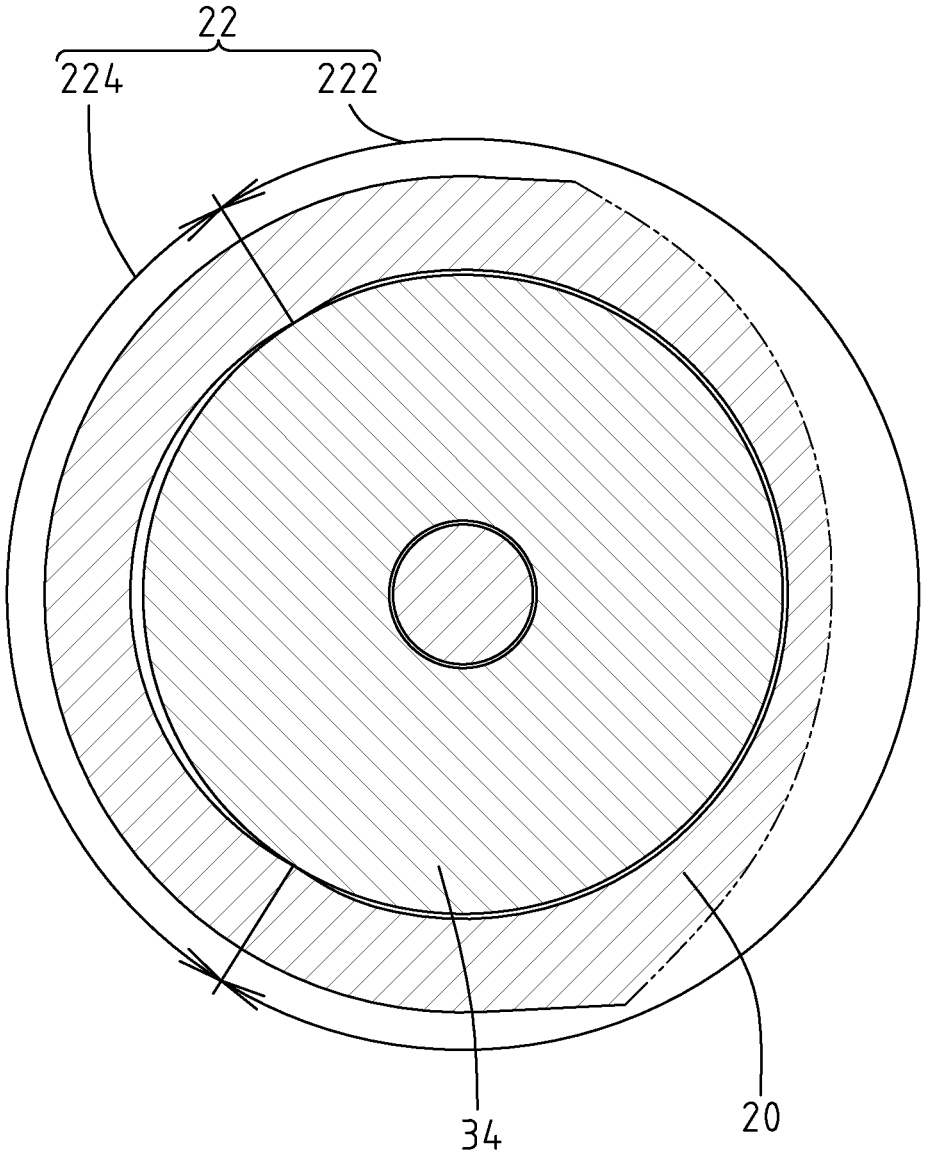
FIG. 5 is the drawing of radial partial enlargement of the first shaft segment and the second receiving groove in Embodiment 1 of the present invention, presenting the contact between the first shaft segment and the second receiving groove.
Figure 6:
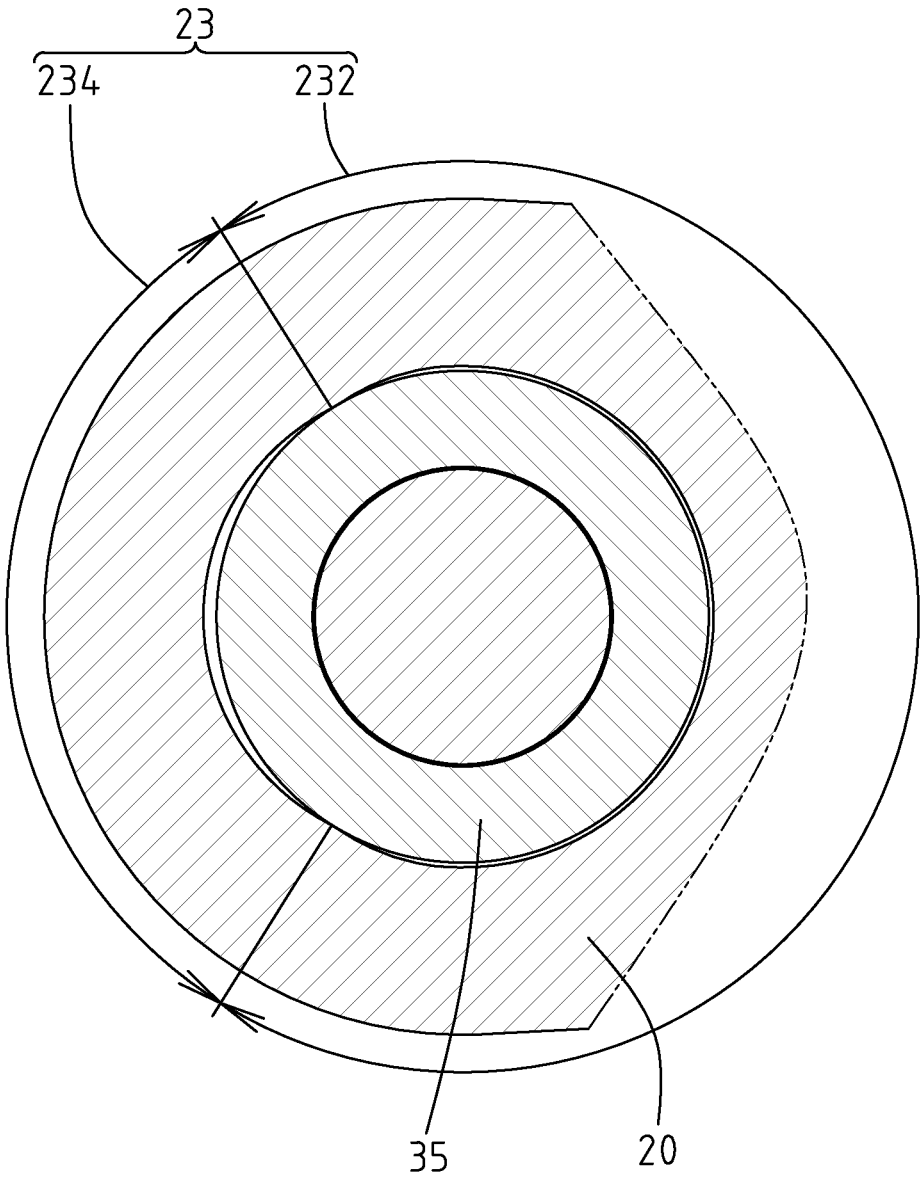
FIG. 6 is the drawing of radial partial enlargement of the second shaft segment and the third receiving groove in Embodiment 1 of the present invention, presenting the contact between the second shaft segment and the third receiving groove.

As shown in Fig.5, the second receiving groove 22 is composed of a first circular surface 222 and a second circular surface 224 connected to each other. The second circular surface 224 is located on the side of the first circular surface 222 far from the brake block 32. The center of the second circular surface 224 is located in the second receiving groove 22. The radius of the first circular surface 222 is greater than the radius of the first shaft segment 34. The radius of the first shaft segment 34 is greater than or equal to the radius of the second circular surface 224. As shown in FIG. 6, the third receiving groove 23 is composed of a third circular surface 232 and a fourth circular surface 234 connected to each other. The fourth circular surface 234 is located on the side of the third circular surface 232 far from the brake block 32. The center of the fourth circular surface 234 is located in the third receiving groove 23. The radius of the third circular surface 232 is greater than the radius of the second shaft segment 35. The rate of radius of the second shaft segment 35 is greater than or equal to the radius of the fourth circular surface 234.

As shown in Fig.5, when the radius of the first circular surface 222 is greater than the radius of the first shaft segment 34 and when the first shaft segment 34 is greater than the radius of the second circular surface 224, the first shaft segment 34 is in line contact with the second receiving groove 22 in at least two places. As shown in FIG. 6, when the radius of the third circular surface 232 is greater than the radius of the second shaft segment 35 and the radius of the second shaft segment 35 is greater than the radius of the fourth circular surface 234, the second shaft segment 35 is in line contact with the third receiving groove 23 in at least two places.

Further, it is preferable that the radius of the first circular surface 222 is greater than the first shaft segment 34 and that the radius of the first shaft segment 34 is equal to the radius of the second circular surface 224. It is also preferable that the radius of the third circular surface 232 is greater than the radius of the second shaft segment 35 and the second shaft segment 35 is equal to the radius of the fourth circular surface 234. When the radius of the first circular surface 222 is greater than the radius of the first shaft segment 34 and the radius of the first shaft segment 34 is equal to the radius of the second circular surface 224, the first shaft segment 34 is in a minimal surface contact with the second circular surface 224. When the third circular surface 232 is greater than the radius of the second shaft segment 35 and the radius of the second shaft segment 35 is equal to the radius of the fourth circular surface 234, the second shaft segment 35 is in small surface contact with the fourth circular surface 234.

In comparison to the known ratchet wrench, the present invention can effectively disperse the relative force between the first shaft segment 34 and the second receiving groove 22, and disperse the relative force between the second shaft segment 35 and the third receiving groove 23, so that the ratchet tool of the present invention can bear higher acting force than the known ratchet wrench, and the first shaft segment 34, the second shaft segment 35, the second receiving groove 22 and the third receiving groove 23 are not damaged, the restriction of the working part 40 on external torsion can be enhanced.

Figure 7:
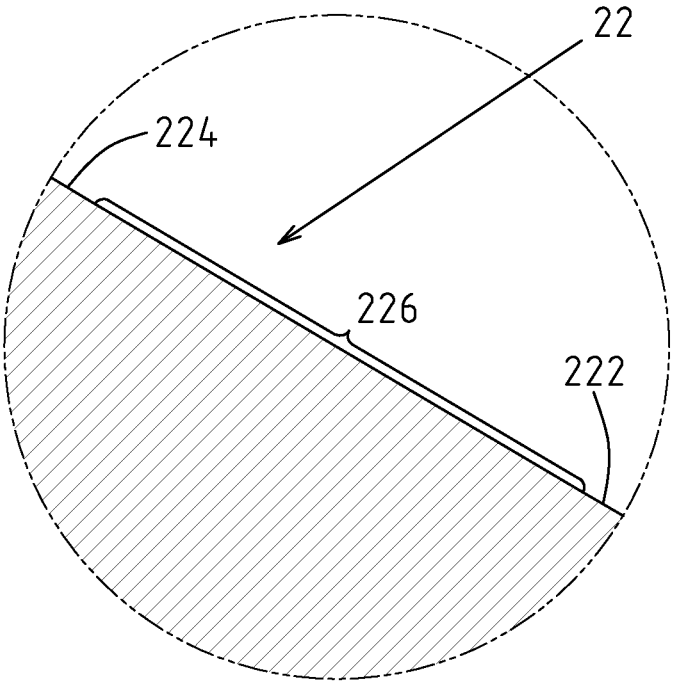
FIG. 7 is the drawing of radial partial enlargement of the second receiving groove in Embodiment 2 of the present invention, presenting the tangent connection of the first joint face to the first circular surface and the second circular surface.

As shown in FIG. 7, Embodiment 2 is different from Embodiment 1 that the second receiving groove 22 forms two first joint faces 226 between the first circular surface 222 and the second circular surface 224, the first joint faces 226 are formed on both sides of the first circular surface 222 and the second circular surface 224 respectively, and the first joint faces 226 are tangential to the first circular surface 222 and the second circular surface 224 respectively, wherein the first joint faces 226 are plane or cambered surface, and the symmetry of the first joint faces 226 is preferred.

Figure 8:
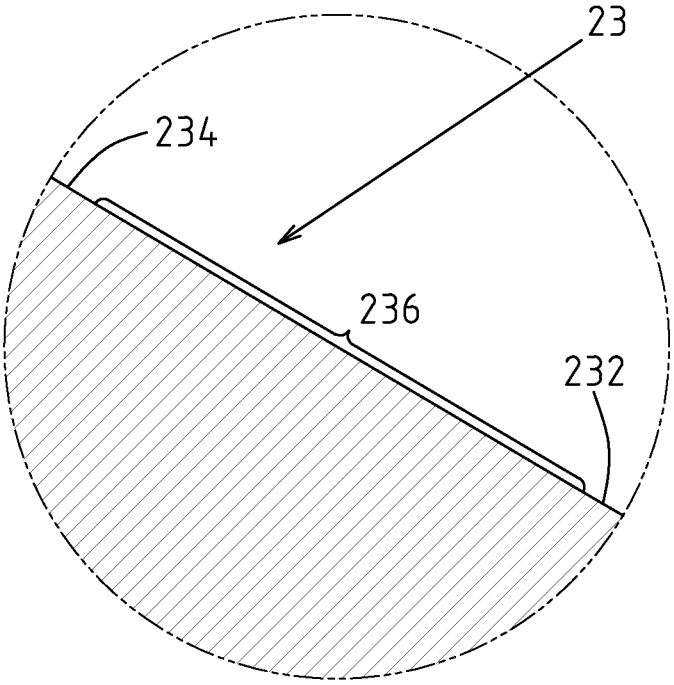
FIG. 8 is the drawing of radial partial enlargement of the third receiving groove in Embodiment 2 of the present invention, presenting the tangent connection of the second joint face to the third circular surface and the fourth circular surface.

As shown in FIG. 8, two second joint faces 236 are formed between the third circular surface 232 and the fourth circular surface 234 of the third receiving groove 23, the second joint faces 236 are formed on both sides of the third circular surface 232 and the fourth circular surface 234 respectively, and the second joint faces 236 are tangential to the third circular surface 232 and the fourth circular surface 234 respectively, wherein the second joint faces 236 are plane or cambered surface, and the symmetry of the second joint faces 236 is preferred.

When the radius of the first circular surface 222 is greater than the radius of the first shaft segment 34 and the radius of the first shaft segment 34 is greater than the radius of the second circular surface 224, the first shaft segment (not shown in the figure) and the second receiving groove 22 of Embodiment 2 are in line contact on the first joint faces 226 respectively; when the radius of the third circular surface 232 is greater than the radius of the second shaft segment 34 and the radius of the second shaft segment 34 is greater than the radius of the fourth circular surface 234, the second shaft segment (not shown in the figure) and the third receiving groove 23 of Embodiment 2 are in line contact on the second joint faces 236 respectively.

Figure 9:
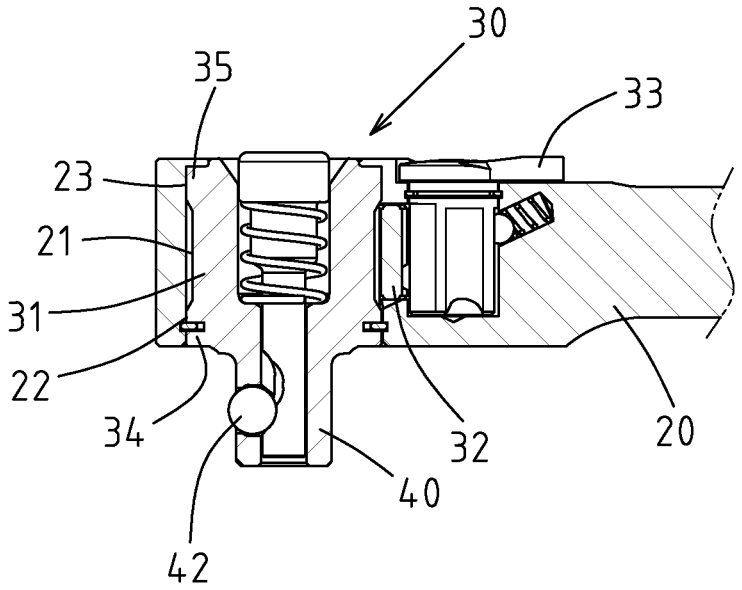
FIG. 9 is the axial sectional view of working part and braking structure in Embodiment 3 of the present invention.
Figure 10:
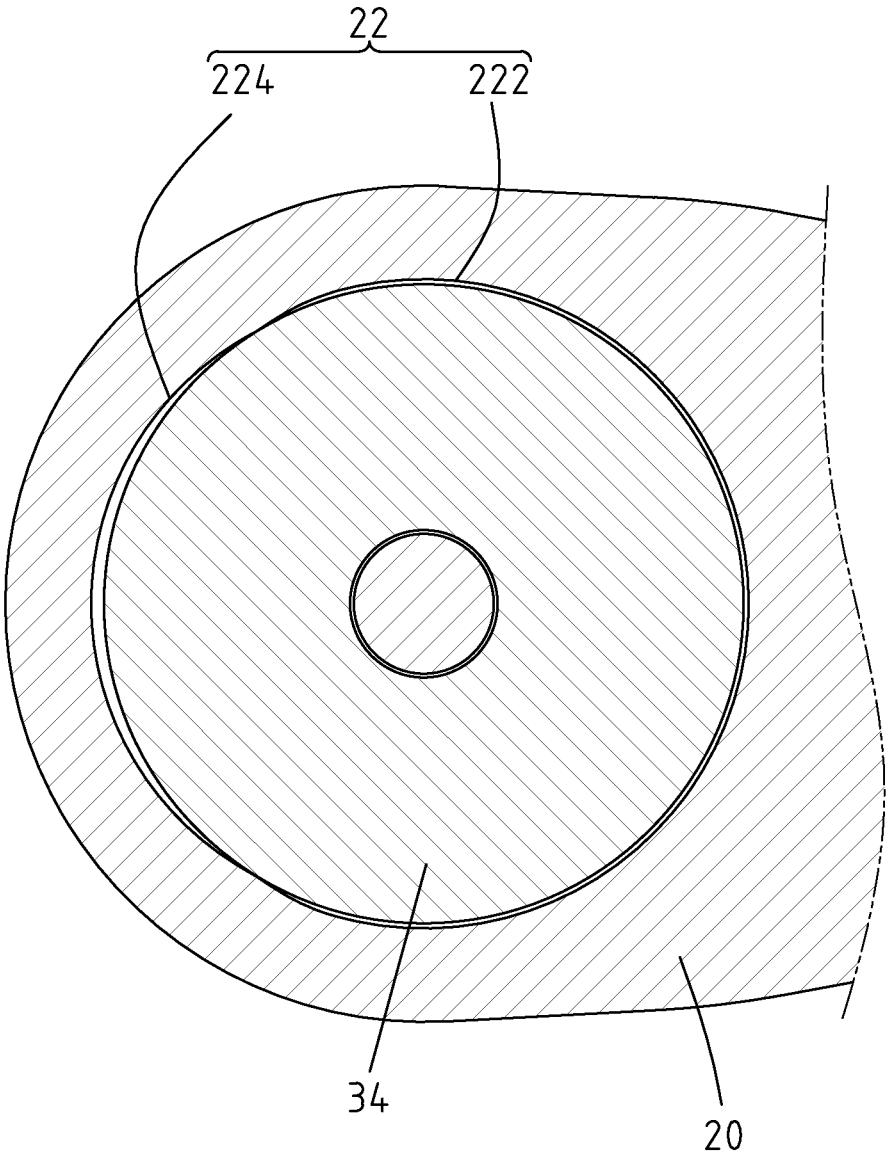
FIG. 10 is the drawing of radial partial enlargement of the first shaft segment and the second receiving groove in Embodiment 3 of the present invention, presenting the contact between the first shaft segment and the second receiving groove.
Figure 11:
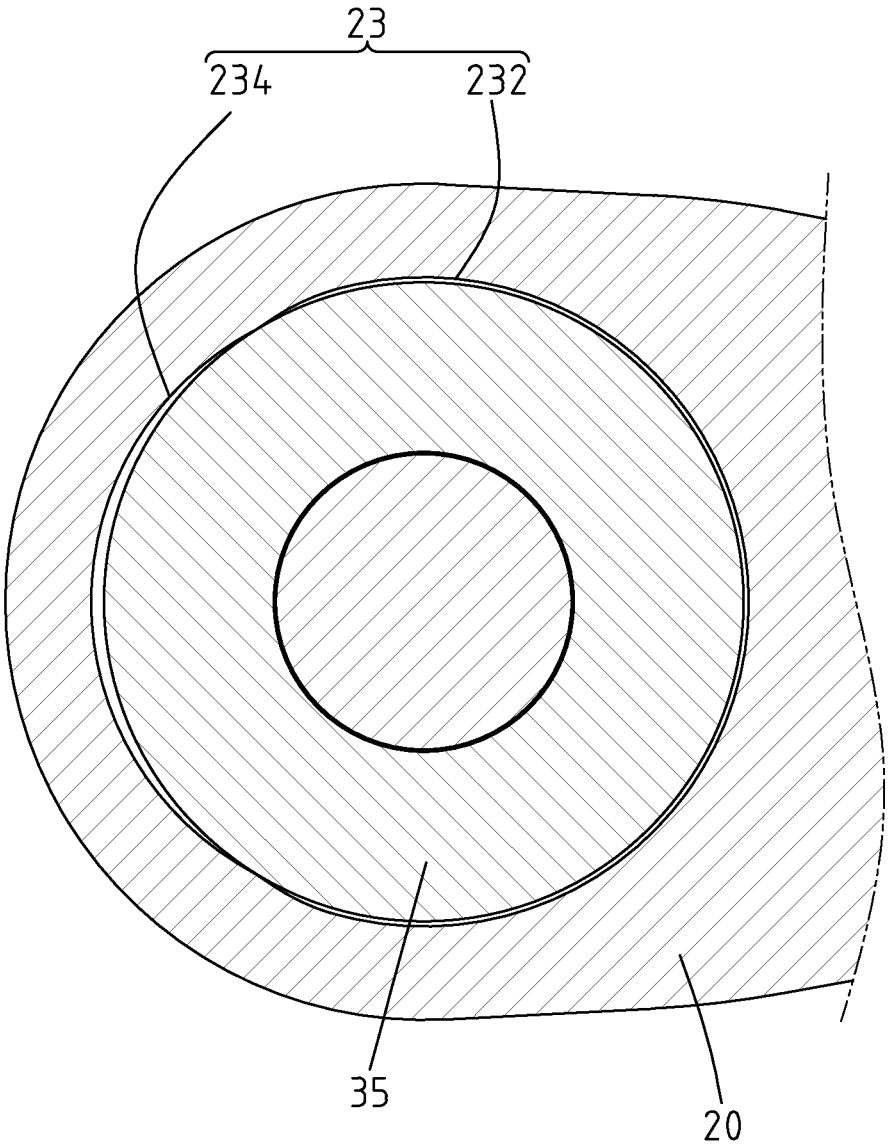
FIG. 11 is the drawing of radial partial enlargement of the second shaft segment and the third receiving groove in Embodiment 3 of the present invention, presenting the contact between the second shaft segment and the third receiving groove.

As shown in FIG. 9 to FIG. 11, Embodiment 3 comprises a main body 20, a braking structure 30 and a working part 40. Embodiment 3 is different from Embodiment 1 in that the radius of the first circular surface 222 is greater than the radius of the first shaft segment 34 and the radius of the first shaft segment 34 is greater than or equal to the radius of the second circular surface 224 and further in that the radius of the third circular surface 232 is greater than the radius of the second shaft segment 35 and that the second shaft segment 34 has a radius that is greater than or equal to the radius of the fourth circular surface 234. The radius of the first shaft segment 34 is equal to the radius of the second shaft segment 35. The radius of the first circular surface 222 is equal to the radius of the third circular surface 232. The radius of the second circular surface 224 is equal to the radius of the fourth circular surface 234.

In another embodiment, the radius of the first shaft segment 34 is equal to the radius of the second shaft segment 35 and the radius of the first circular surface 222 is equal to the radius of the third circular surface 232 and the radius of the second circular surface 224 is equal to the radius of the fourth circular surface 234, the second receiving groove 22 and the third receiving groove 23 can be formed at a time by using the same cutting tool, so that the second receiving groove 22 and the third receiving groove 23 are likely to have the same machining accuracy. The first shaft segment 34 and the second shaft segment 35 are likely to contact the second receiving groove 22 and the third receiving groove 23 in the same position, so as to avoid eccentric wear, favorable for improving the service life.

Figure 12:
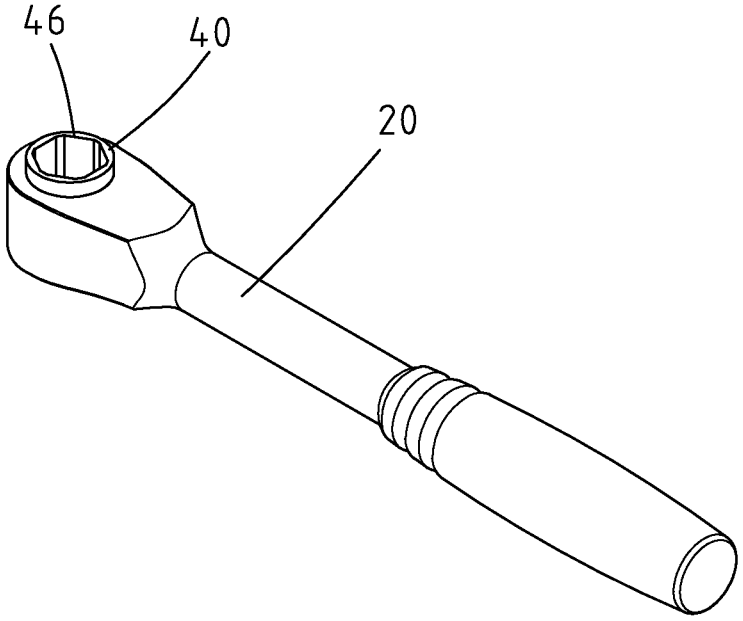
FIG. 12 is the stereogram of Embodiment 4 of the present invention.

Embodiment 4 is the implementation option applied to ratchet wrench, as shown in FIG. 12, the Embodiment 4 comprises a main body 20, a braking structure (not shown in the figure) and a working part 40. Embodiment 4 is different from Embodiment 1 that the working part 40 has a sleeve hole 46, so that the working part 40 is fitted over a driven object (not shown in the figure) through the sleeve hole 46, the main body 20 is the handle of ratchet wrench.

Based on said structural composition and technical characteristics, the high-loading ratchet tool of the present invention can bear higher acting force, so that the restriction of the working part 40 on external torsion is enhanced.

I claim:

1. A ratchet tool comprising:

a main body having a first receiving groove and a second receiving groove and a third receiving groove, the first receiving groove and the second receiving groove and the third receiving groove are axially connected, the first receiving groove being positioned between the second receiving groove and the third receiving groove;

a braking structure disposed on said main body, said braking structure having a ratchet and a brake lock, wherein the brake block engages with the ratchet to form a one-way stop, the ratchet having a pair of ends that axially form a circular first shaft segment and a circular second shaft segment respectively, the ratchet being movably disposed in the first receiving groove, the circular first shaft segment being movably disposed in the second receiving groove, the circular second shaft segment being movably disposed in the third receiving groove; and a working part coupled to the circular first shaft segment such that said working part directly or indirectly brakes a unidirectional rotation of an object driven by the ratchet tool, wherein the second receiving groove has a first circular surface and a second circular surface, the second circular surface being located on a side of the first circular surface away from the brake block, wherein a center of the second circular surface is positioned in the second receiving groove, a radius of the first circular surface being greater than a radius of the circular first shaft segment, the radius of the circular first shaft segment being greater than or equal to a radius of the second circular surface, wherein the third receiving groove has a third circular surface and a fourth circular surface, the fourth circular surface being positioned on a side of the third circular surface away from the brake block, wherein a center of the fourth circular surface is located in the third receiving groove, a radius of the third circular surface being greater than a radius of the circular second shaft segment and the radius of the circular second shaft segment is greater than or equal to a radius of the fourth circular surface, wherein an inner groove wall of the second receiving groove forms at least one first joint face between the fourth circular surface and the second circular surface, the at least one first joint face being formed on at least one side of the fourth circular surface and the second circular surface, wherein the at least one first joint face is tangential to the fourth circular surface and the second circular surface, wherein an inner groove wall of the third receiving groove forms at least one second joint face between the third circular surface and the fourth circular surface, the at least one second joint face being formed on at least one side of the third circular surface and the fourth circular surface, the at least one second joint face being tangential to the third circular surface and the fourth circular surface.

2. The ratchet tool of claim 1, wherein the radius of the circular first shaft segment is greater than the radius of the second circular surface.

3. The ratchet tool of claim 2, wherein the radius of the circular first shaft segment is equal to the radius of the circular second shaft segment, the radius of the fourth circular surface is equal to the radius of the third circular surface, the radius of the second circular surface being equal to the radius of fourth circular surface.

4. The ratchet tool of claim 1, wherein the radius of the circular first shaft segment is equal to the radius of the circular second shaft segment, the radius of the fourth circular surface is equal to the radius of the third circular surface, the radius of the second circular surface being equal to the radius of fourth circular surface.

* * * * *